US008813965B2

(12) United States Patent
Cheema et al.

(10) Patent No.: US 8,813,965 B2
(45) Date of Patent: Aug. 26, 2014

(54) CARTON, BLANK AND METHOD OF PACKAGING

(75) Inventors: Parbinder Cheema, Birmingham (GB); Richard Andrews, Birmingham (GB)

(73) Assignee: Cadbury UK Limited, Bournville (GB)

( * ) Notice: Subject to any disclaimer, the term of this patent is extended or adjusted under 35 U.S.C. 154(b) by 0 days.

(21) Appl. No.: 13/377,966

(22) PCT Filed: Jun. 17, 2010

(86) PCT No.: PCT/GB2010/051006

§ 371 (c)(1),
(2), (4) Date: Mar. 2, 2012

(87) PCT Pub. No.: WO2010/149998

PCT Pub. Date: Dec. 29, 2010

(65) Prior Publication Data

US 2012/0152768 A1 Jun. 21, 2012

(30) Foreign Application Priority Data

Jun. 27, 2009 (GB) ..... 0911176.6

(51) Int. Cl.

| | |
|---|---|
| ***B65D 5/50*** | (2006.01) |
| ***B65D 85/60*** | (2006.01) |
| ***B65D 5/48*** | (2006.01) |

(52) U.S. Cl.

CPC ..... *B65D 5/48014* (2013.01); *B65D 5/48016* (2013.01); *B65D 85/60* (2013.01); *B65D 5/5016* (2013.01); *B65D 5/5014* (2013.01)

USPC ..... 206/775; 206/588; 206/765; 206/769; 229/120.13; 229/120.18; 426/120

(58) Field of Classification Search

CPC ..... B65D 5/4204; B65D 5/48016; B65D 5/5002; B65D 5/5004; B65D 5/5007; B65D 5/5009; B65D 5/5011; B65D 5/5014; B65D 5/5016; B65D 5/5069; B65D 85/60

USPC ..... 206/521.2, 588, 592, 730, 733–735, 206/745, 746, 756, 764, 765, 769, 772–774, 206/775, 779, 780, 782; 229/120.13, 229/120.14, 120.15, 120.18, 120.21; 426/106, 112–115, 119, 120

See application file for complete search history.

(56) References Cited

U.S. PATENT DOCUMENTS 2,727,620 A * 12/1955 Buttery et al. ..... 206/779
3,712,461 A * 1/1973 Schillinger ..... 206/779

(Continued)

FOREIGN PATENT DOCUMENTS

FR 1134361 4/1957
FR 2823489 A1 * 10/2002

(Continued)

*Primary Examiner* — Bryon Gehman
(74) *Attorney, Agent, or Firm* — Hoffmann & Baron, LLP

(57) ABSTRACT

A carton (10) is formed from a unitary blank of material folded to produce a hollow walled structure for encircling a main product (11). The blank is also folded to produce at least one internal divider (35) which forms a support for holding the main product (11) in position in the structure and to define within the hollow walled structure an internal volume (36) for retaining a secondary item (37). The internal divider (35) may extend transversely or longitudinally. Where the internal divider is aligned longitudinally of the housing, it may be parallel to a side wall of the carton or it may extend across a corner between two side walls. The internal divider may be provided by a pair of kick-ins. The carton (10) may be an Easter egg carton. Methods of forming and filling the carton are also described.

9 Claims, 9 Drawing Sheets

(56) References Cited

U.S. PATENT DOCUMENTS

| | | | | | |
|---|---|---|---|---|---|
| 4,037,717 | A | * | 7/1977 | Roccaforte | 206/783 |
| 4,159,765 | A | * | 7/1979 | Roccaforte | 206/782 |
| 4,385,687 | A | * | 5/1983 | Dutcher | 206/779 |
| 4,925,087 | A | * | 5/1990 | Ostrander | 229/120.15 |
| 5,156,277 | A | * | 10/1992 | Witz | 206/592 |
| 5,816,411 | A | | 10/1998 | Smith | |
| 6,371,366 | B1 | * | 4/2002 | Edgerton et al. | 206/756 |

FOREIGN PATENT DOCUMENTS

| | | | |
|---|---|---|---|
| FR | 2915181 | | 10/2008 |
| GB | 1174044 | A * | 12/1969 |
| GB | 1379751 | A * | 1/1975 |
| GB | 2154213 | A * | 9/1985 |
| GB | 2235434 | A * | 3/1991 |

* cited by examiner

CARTON, BLANK AND METHOD OF PACKAGING

CROSS-REFERENCE TO RELATED APPLICATIONS

This application is the National Stage of International Application No. PCT/GB2010/051006, which designates the U.S., filed Jun. 17, 2010, which claims the benefit of Great Britain Application No. GB 0911176.6 filed Jun. 27, 2009, the contents of which are incorporated by reference herein.

TECHNICAL FIELD OF THE INVENTION

The present invention relates to a carton for packaging a product, in particular but not exclusively for packaging a hollow confectionery product such as an Easter egg or hollow chocolate animal. The invention also relates to a packaging assembly comprising the carton, a blank for forming the carton and to methods of forming and filling the carton.

BACKGROUND TO THE INVENTION

It is known to package Easter eggs and other hollow confectionery items such as chocolate animals in a carton for display purposes. Known cartons for Easter eggs are typically shaped to enable a number of similar cartons to be stacked on a display shelf. Often the carton will take the form of a hollow tube of polygonal shape having four or more side wall regions which encircle the egg. The upper and lower ends of the carton may be at least partially closed. The external surface of the known cartons are typically printed on to carry information for the consumer and to make the packaging attractive. One or more of the side wall regions of the carton will often have a window to enable of the egg to be seen. The egg itself may also be wrapped in a foil or other material.

Due to the shape of the egg, it is usually necessary to provide one or more internal supports to hold the egg securely in the carton. This is to prevent the egg from moving about inside the carton and being damaged during transport and/or handling. Where the carton has one or more windows, the egg is held in a suitable position for viewing.

Recently, it has become popular to package Easter eggs together with other, secondary confectionery items such as a bag of sweets or chocolates or one or more chocolate bars or with a toy or other gift. These secondary items are often accommodated within the carton and must held in position so as not to move about and damage the egg during transit and/or handling.

Known Easter egg cartons are often formed from a blank of stiff but foldable material, such as cardboard, paperboard, carton board and the like. Where a secondary item is to be packaged within the carton, it is known to provide a separate insert which is located in the carton to act as a support for the egg and which is provided with one or more recesses for receiving and holding a secondary confectionery item. The inserts may be made of card or plastic, for example.

Packaging of Easter eggs is a largely automated process carried out by machinery arranged to form a carton from a blank and to insert the egg and any secondary items into the carton at an appropriate stage in the process. The use of a separate insert to support the egg and to hold any secondary confectionery adds to the complexity of the overall packaging process. In addition, there is increasing pressure on manufactures to reduce the amount of packaging used.

In an alternative arrangement, GB 2 235 434 A discloses a carton for an Easter egg formed from a blank of foldable material. The carton has a display window and part of the blank where the window opening is defined is formed to produce a pocket for housing an ancillary article. Whilst this arrangement avoids the need for a separate insert for holding a secondary item, it results in a pocket which is at least partially open to the exterior of the carton through the window.

It is an object of the present invention to overcome, or at least mitigate, some or all of the disadvantages of the known cartons for packaging a main product together with a secondary item.

It is a particular object of the present invention to overcome, or at least mitigate, some or all of the disadvantages of the known cartons for packaging an Easter egg together with a secondary item.

It is a further object of the invention to provide an improved or alternative blank for forming a carton for packaging a main product and at least one secondary item.

It is a further object of the invention to provide improved or alternative methods of forming an filling a carton for packaging a main product and at least one secondary item which overcome, or at least mitigate, some or all of the disadvantages of the known of methods

SUMMARY OF THE INVENTION

In accordance with a first embodiment of the invention, there is provided a carton for packaging a main product and at least one secondary item, the carton comprising a unitary blank of foldable material folded to produce a hollow walled structure for encircling the main product, the unitary blank also being folded to produce at least one internal divider which forms a support to assist in holding the main product in position in the structure and to define within the hollow walled structure an internal volume for retaining a secondary item.

The internal volume may be completely contained within the hollow walled structure.

In an embodiment, the internal divider extends transversely across the structure at a position spaced inwardly from one end, the blank further comprising one of more flaps which form an end closure for the hollow walled structure at or close to said one end so that the internal volume for retaining a secondary item is defined within the hollow walled structure between the divider and the end closure. The end closure may be an end closure for a lower end of the carton.

In an alternative embodiment, the internal divider extends longitudinally of the structure between two side wall regions, so that a volume for retaining a secondary item is defined within the hollow walled structure between the divider and a side wall region. The divider may extend substantially the whole length of the hollow walled structure and the blank further comprises one or more flaps which form an end closure at either end of the hollow walled structure, the end closures also co-operating with the divider to form end closures for the volume.

The hollow walled structure may be in the form of a tube having a polygonal cross section and having four or more planar side wall panels.

Where the internal divider extends longitudinally of the structure, the divider may extend between two opposing side wall panels parallel to but spaced from a further side wall panel. Alternatively, the divider may extend between two adjacent side wall panels across a corner defined where the two adjacent side wall panels meet.

The divider may comprise a first tab foldably connected with a side wall panel of the hollow walled structure, a main divider panel foldably connected with the first divider tab and at least one second tab connected with the main divider panel.

In an embodiment where the divider extends transversely across the structure, the first divider tab may be foldably connected to a lower edge of one side wall panel folded so as to extend upwardly adjacent to the inner surface of said one side wall panel with the main divider panel folded so as to extend transversely across the hollow walled structure.

In an alternative embodiment where the divider extends in a longitudinal direction of the structure, the first divider tab may be foldably connected with a side edge of one side wall panels.

The first tab may extend adjacent an inner surface of one side wall panel.

The at least one second tab may be foldably connected to the divider main panel portion and arranged to extend adjacent an inner surface of a further side wall panel. A free end of the at least one second divider tab may be supported by an end closure of the carton.

At least one of the first and second divider tabs may be bonded to the inner surface of its respective side wall panel.

In an alternative arrangement, the least one second divider tab is received in a corresponding slot in a side wall panel of the carton.

The main divider panel may comprise two or more panel portions separated by fold lines, each panel portion extending at an angle to an adjacent panel portion. In this case, where the divider extends longitudinally of the structure across a corner defined where the two adjacent side wall panels meet, the main divider panel may have two panel portions extending at approximately 90 degrees to one another, the fold line between the panel portions being aligned diametrically opposite the corner between the two adjacent side wall regions.

The main divider panel may have an opening to receive part of the main product.

The divider may take the form of a pair of opposed kick-ins.

The main product may be a hollow confectionery product such as an Easter egg or a hollow chocolate animal and the secondary item may be a secondary confectionery item.

In accordance with a second embodiment of the invention, there is provided a unitary blank of foldable material for forming a carton in accordance with the first embodiment.

The blank may comprise a plurality of side wall panels separated by fold lines, a first divider tab connected to an edge of one of the side wall panels, a divider main panel foldably connected to first divider tab and at least one second divider tab. The first divider tab may be foldably connected to a transverse end edge or a longitudinal side edge of said one of the side wall panels.

The at least one second divider tab may be foldably connected to the divider main panel. Alternatively, the at least one second divider tab may project from an edge of the divider man panel portion and the blank may have one or more corresponding slots for receiving a respective second divider tab.

The divider main panel may comprise two or more panel portions separated by a fold line.

The main divider panel may have an opening for receiving part of a main product in the completed carton.

In an alternative arrangement, the blank comprises a plurality of side wall panels separated by fold lines and has two flaps for forming part of an end closure at one end of the carton, each of the flaps being foldably connected to an edge of a respective one of the side wall panels, a kick-in being defined by means of a pair of spaced cuts extending across the connection between each of the respective side wall panels and the associated end closure flap.

The blank may comprise flaps for forming end closures at either end of the hollow walled structure in the completed carton, each flap being foldably connected to an edge of a respective side wall panel.

In accordance with a third embodiment of the invention, there is provided a method of forming and filling a carton in accordance with the first embodiment in which the internal divider extends transversely across the structure at a position spaced inwardly from one end, the method comprising:

- folding the blank to form a hollow walled structure and securing;
- forming the internal divider and securing in position;
- with the partly formed carton in an upright position, inserting a main product into the hollow walled structure through a first end so that the product rests on the divider;
- forming a closure at the first end of the structure and securing in position;
- inverting the carton with the product in position and inserting a secondary item into the volume between the divider and a second end of the structure opposite from the first end;
- forming a closure for the second end.

In accordance with a fourth embodiment of the invention, there is provided a method of forming and filling a carton in accordance with the first embodiment in which the internal divider extends transversely across the structure at a position spaced inwardly from one end, the method comprising:

- folding the blank to form a hollow walled structure and securing in position;
- forming a closure at a first end of the structure;
- with the carton aligned generally horizontally, inserting a main product into the partially formed carton though a second end of the structure opposite from the first;
- forming the divider;
- inserting a secondary item in to the volume between the divider and the second end of the structure;
- forming a closure at the second end of the structure.

In accordance with a fifth embodiment of the invention, there is provided a method of forming and filling a carton in accordance with the first embodiment in which the internal divider extends transversely across the structure at a position spaced inwardly from one end, the method comprising:

- folding the blank to form a hollow walled structure and securing in position;
- forming the divider;
- inserting a main product into the carton through a first end of the structure;
- inserting a secondary item in to the volume between the divider and a second end of the structure opposite from the first;
- forming a closure at each end of the structure.

In the method of the fifth embodiment, the hollow walled structure may be positioned so that its longitudinal axis is aligned generally horizontally and the main product and the secondary item introduced from opposite sides.

In any of the methods in accordance with the third to fifth embodiments of the invention, the main product may be a hollow confectionery product such as an Easter egg or a hollow chocolate animal and the secondary item may be a secondary confectionery item.

In accordance with a sixth embodiment of the invention, there is provided a package assembly comprising a carton for packaging a main product and at least one secondary item, the carton being formed from a unitary blank of foldable material folded to produce a hollow walled structure for encircling the main product, the unitary blank also being folded to produce at least one internal divider which forms a support to assist in holding the main product in position in the structure and to define within the hollow walled structure an internal volume for retaining a secondary item, the assembly further comprising a main product located within the hollow walled structure and supported by the divider, and at least one secondary product located within internal volume.

The main product may be a confectionery product such as an Easter egg.

The at least one secondary product may be a confectionery product.

DETAILED DESCRIPTION OF THE INVENTION

Several embodiments of the invention will now be described, by way of example only, with reference to the accompanying drawings, in which.

The same reference numerals but increased by 100 in each case will be used to identify features that are the same or which fulfil the same function in each of the embodiments to be described.

Figure 1:
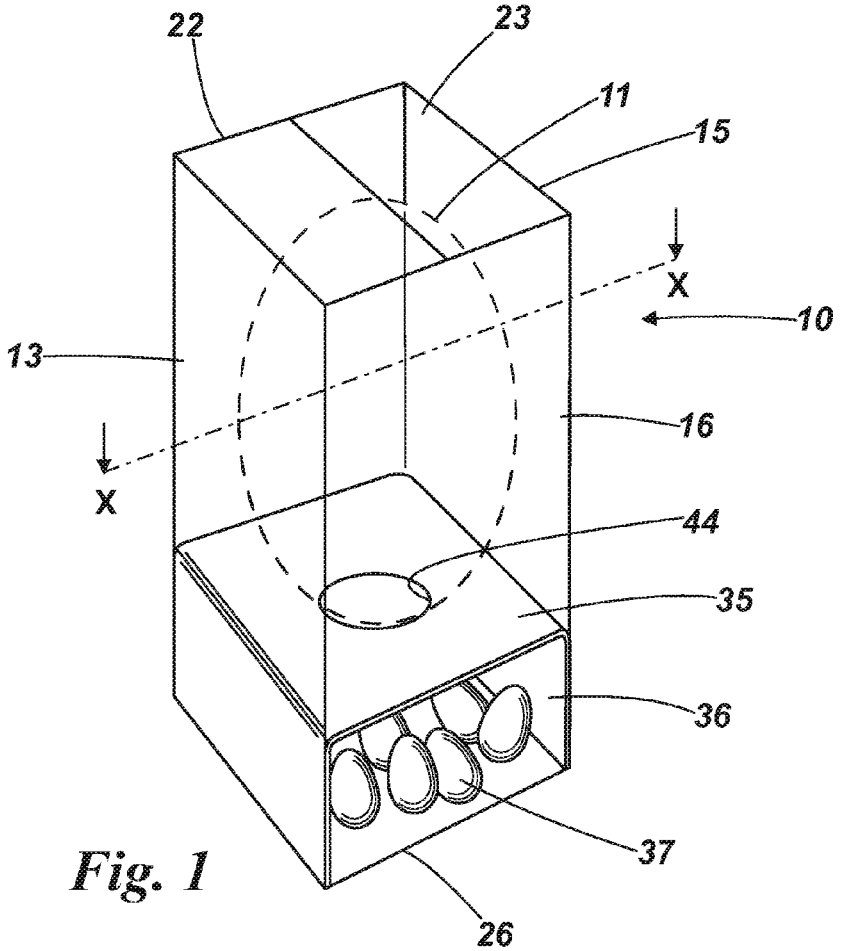
FIG. 1 is a schematic perspective view of a carton in accordance with a first embodiment of the invention.

The terms upper and lower, horizontal and vertical and the like are used herein to refer to the completed carton and parts thereof when the carton is stood upright in the orientation in which it is intended to be displayed to the consumer, as shown in FIG. 1 for example, and should in interpreted accordingly. However, it will be appreciated that the carton can be assembled, stored and used in other orientations.

Figure 2:
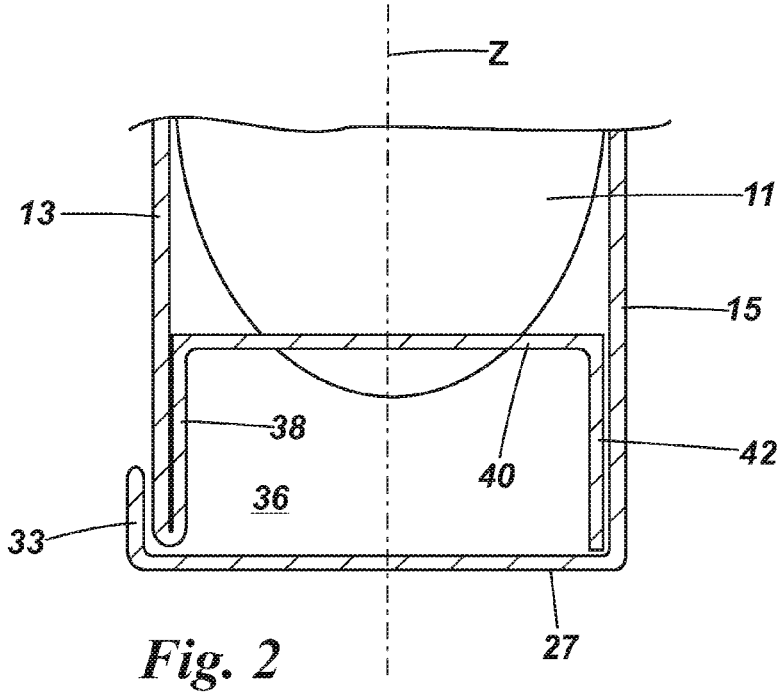
FIG. 2 is a cross sectional view through a lower portion of the carton of FIG. 1 taken on line X-X.
Figure 3:
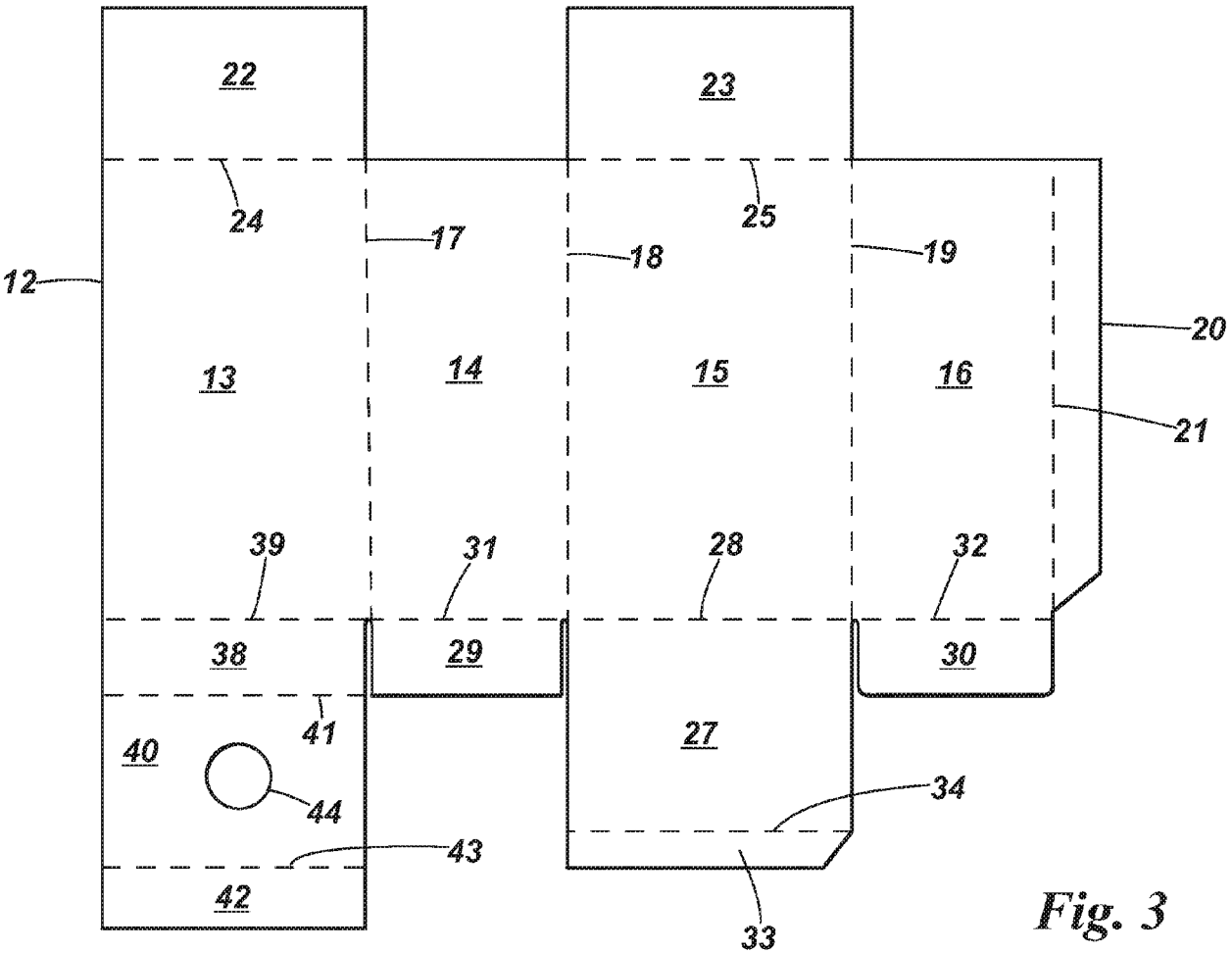
FIG. 3 is a plan view of a blank for forming the carton of FIGS. 1 and 2.

FIGS. 1 to 3 illustrate a first embodiment of a carton 10 for an Easter egg 11 in accordance with the invention.

The carton 10 is formed from a unitary blank 12 of a stiff yet foldable material, such as cardboard, paperboard, carton board and the like. The blank 12 comprises four side wall panels 13, 14, 15, 16 which are separated by fold lines 17, 18, 19. A longitudinal side tab 20 is connected to a free edge of one of the side wall panels 16 by a fold line 21.

To produce the carton, the blank 12 is folded about the fold lines 17-19 so that the side wall panels 13-16 form a rectangular, tubular hollow walled structure having two pairs of opposing side walls for encircling the egg 11. The side tab 20 is affixed to the fourth side wall panel 16 to secure the structure using an adhesive in a known manner.

The terms "tube" or "tubular" as used herein, including in the claims, is not limited to structures having a circular cross section but includes structures having a square, rectangular or other polygonal shape in cross section.

A closure 22 for the upper end of the hollow walled structure is provided by two end flaps 23. One of the flaps 23 is connected with a first one of the side wall panels 13 by a fold line 24. The other of the flaps is connected with a third one of the side wall panels 15, which forms a side wall opposite from that formed by the first panel 13, by a further fold line 25. Once the blank has been folded to form the hollow walled structure, the upper end flaps 23 can be folded down about the fold lines 24, 25 and secured together to close the upper end of the carton. It will be appreciated that the upper closure could be formed using a variety of different flap and tab arrangements as is known in the art.

A closure 26 for the lower end of the hollow walled structure is formed by means of a major lower end closure flap 27 which is connected with a lower edge of the third side wall panel 15 by means of a fold line 28. The lower end closure 26 also includes a pair of minor lower end closure flaps 29, 30 which are each connected to a lower edge of a respective one of the second and fourth side wall panels 14, 16 adjacent the third side wall panel 15 by means of fold lines 31, 32. To form the lower end closure 26, the minor flaps 29, 30 are folded inwardly about the fold lines 31, 32 and the major lower end closure flap 27 is folded about the fold line 28. The major flap 27 extends fully across the hollow walled structure and is secured to the opposing side wall of the structure by means of a tab 33 connected to its free edge by a fold line 34. The tab 33 can be affixed to the inner or outer surface of the opposing side wall region of the hollow walled structure using a suitable adhesive in a known manner.

The carton has an integral internal divider 35 that extends transversely across the hollow walled structure at a position spaced inwardly (upwardly) from the lower end closure 26. The internal divider 35 acts as a lower support for the egg 11 to sit on and also defines an internal volume 36 between itself and the lower end closure 26 in which a secondary confectionery item or items 37 can be held.

The internal divider 35 in this embodiment extends generally in a transverse plane so that when the structure in an upright orientation in which the longitudinal axis Z is aligned vertically, the divider extends generally horizontally. Reference to the divider extending "generally in a transverse plane" refers to the overall orientation of the divider and does not necessarily imply that the divider is strictly planar. In alternative embodiments, the divider 35 could have one or more fold lines so that it undulates across the structure. The divider 35 could also be arranged at an angle so as to slope downwardly or upwardly across the structure.

To form the integral internal divider, the blank 12 is provided with a first divider tab portion 38 connected with a lower edge of the first side wall panel 13 by a fold line 39, a main divider panel 30 connected to the first divider tab portion by a fold line 41, and a second divider tab portion 42 connected with the main divider panel by a fold line 43.

The internal divider 35 can be formed after the blank 12 has been folded to produce the tubular hollow walled structure but before the lower end closure has been produced. As can be seen best in FIG. 2, the first divider tab portion 38 is folded inwardly about fold line 39 so as to extend substantially parallel to the inner surface of the first side wall panel 13. The main divider panel portion 40 is folded about fold line 41 to extend transversely across the hollow walled structure towards the opposing, third side wall panel 15. The second divider tab portion 42 is folded outwardly (downwardly) about fold line 43 so as to extend substantially parallel to the inner surface of the third side wall panel 15. In the present embodiment, the first and second divider tabs 38, 42 are the same length so that the free end of the second tab 42 rests on the inner surface of the lower end closure 26 when it is formed. In this case, contact between the end of the second tab 42 and the lower end closure can be utilised to hold the divider in position. Alternatively, or in addition, one or both of the first and second divider tabs 38, 42 can be secured to their respective side wall panels 13, 15 by means of an adhesive. Where the second divider tab 42 is secured to its side wall panel 15 by adhesive, it could be made shorter than the first divider tab 38 so that it does not contact the lower end closure 26. Indeed, the second divider tab 42 could be folded inwardly so that it extends upwardly rather than downwardly in this case.

As illustrated in FIG. 2, the tab 33 on the major end closure flap 27 can be secured to the outer surface of the side wall panel 13. Alternatively, the tab 33 could be secured to the first divider tab 38 after the divider has been formed.

The main divider panel portion has an opening 44 at its centre in which a lower end of the egg 11 is received to hold the egg in position. With the egg 11 in place and the lower end closure 26 formed, the region between the divider 35 and the lower end closure 26 forms a fully enclosed volume in which a secondary confectionery product can be held securely. In the present embodiment, the secondary confectionery item is shown as being mini-eggs but this is not essential and the secondary confectionery item could any suitable item such as a bag of sweets or chocolates or one or more chocolate bars for the like. The internal volume could also be used to hold non-confectionery items such as a toy or the like.

It is expected that the carton 10 in accordance with the first embodiment will be formed and filled using machinery in an automated or semi-automated process. There are a number of methods by which the carton 10 can be formed and filled.

In one method, the hollow walled structure is produced and the internal divider 35 formed and held in position using an adhesive. With the carton in an upright position, the egg 11 is introduced through the upper end so as to rest on the divider 35. The upper end of the carton can then be closed and the carton inverted and a secondary confectionery item introduced into the volume 36 before the lower end closure 26 is formed.

In an alternative method, the tubular hollow walled structure is produced initially and one end (the upper end) of the carton closed. With the partially formed container in a generally horizontal orientation, the egg is introduced through the opposite (lower) end of the structure carton. The internal divider 35 is then fanned and a secondary item 37 introduced into the volume 36 before the closure 26 at the opposite is formed. Using this method, the internal divider need not be secured in position using an adhesive and the lower edge of the second divider tab 42 can be supported on the lower end closure. However, a divider that is adhered in position can still be used. This method has the advantage that the carton does not have to be turned around or otherwise manipulated during the filling process.

In a further alternative method, the hollow walled structure is produced and the internal divider 35 formed. The egg and the secondary item are introduced into the carton from opposite ends either side of the divider and the end closures formed. This method can also be used with the hollow walled structure aligned horizontally without the need to invert or otherwise manipulate the carton during the filling process.

Whilst several methods of forming and filling the carton 10 have been described, it will be appreciated that the various folding, securing and filling steps can be undertaken in a number of different sequences.

It will be appreciated that the carton 10 can be modified in a number of ways. For example, the upper and lower closures 22, 26 can be formed in a number of different ways. For example, in this and all the embodiments disclosed, the upper and lower end closures 22, 26 need not fully close the ends of the tubular structure. It is sufficient if the end closures cover enough of the ends to prevent the egg and the secondary item from falling out of the carton. In addition, one or more of the side wall panels 13-16 may be provided with an opening so that the egg 11 can be viewed. Furthermore, rather than having one second divider tab 42 on the opposite end of the main divider panel 40 from the first tab, the divider could have two second tabs, one on each side of the main divider panel 40. Indeed, the divider 35 could have three second tabs 42 one along each free edge of the main panel 40.

Figure 4:
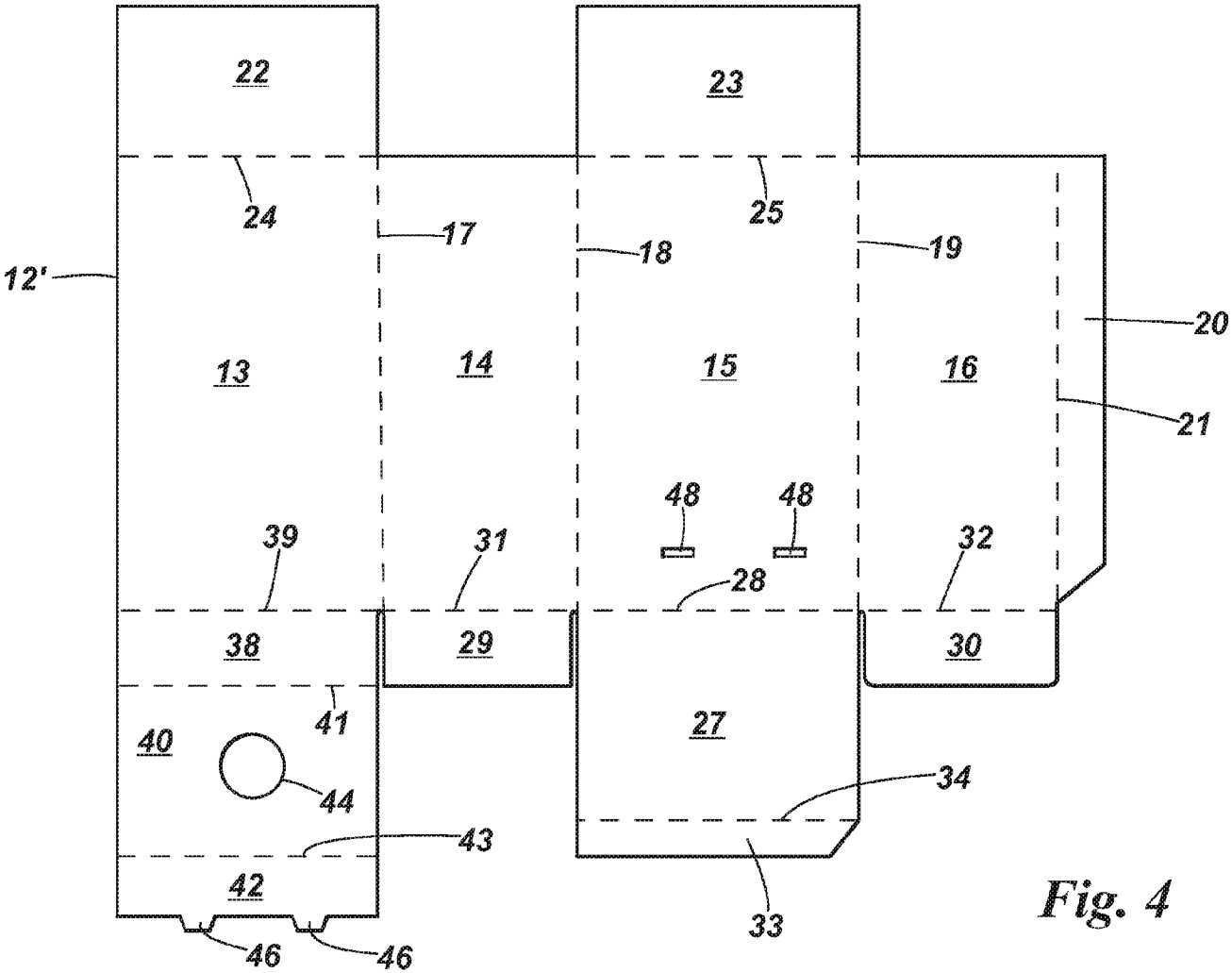
FIG. 4 is a plan view of a blank for forming a modified version of the carton of FIG. 1.
Figure 5:
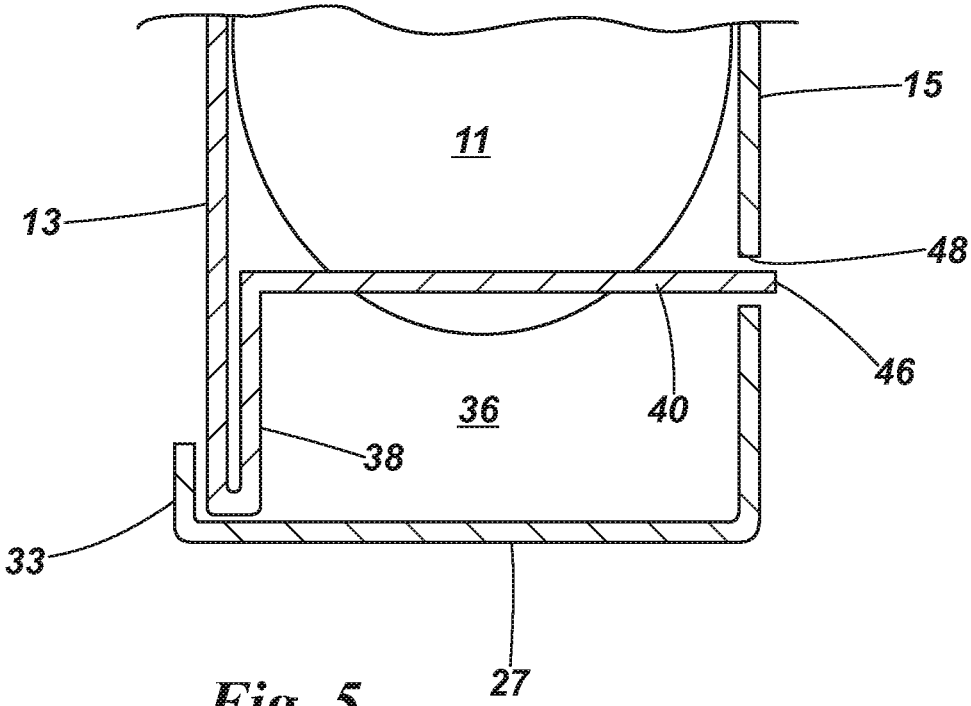
FIG. 5 is a view similar to that of FIG. 2 but showing a modified carton formed from the blank of FIG. 4.

FIGS. 4 and 5 illustrate a modified arrangement for securing the divider 35 in position. Instead of the divider having a foldable second tab 42, the divider in the modified blank 12' has a pair of tabs 46 which project from the free edge of the main panel 40. A corresponding pair of slots 48 are located in the third side wall panel portion 15 into which the tabs 46 are inserted when the blank is folded, as illustrated in FIG. 5.

Figure 7:
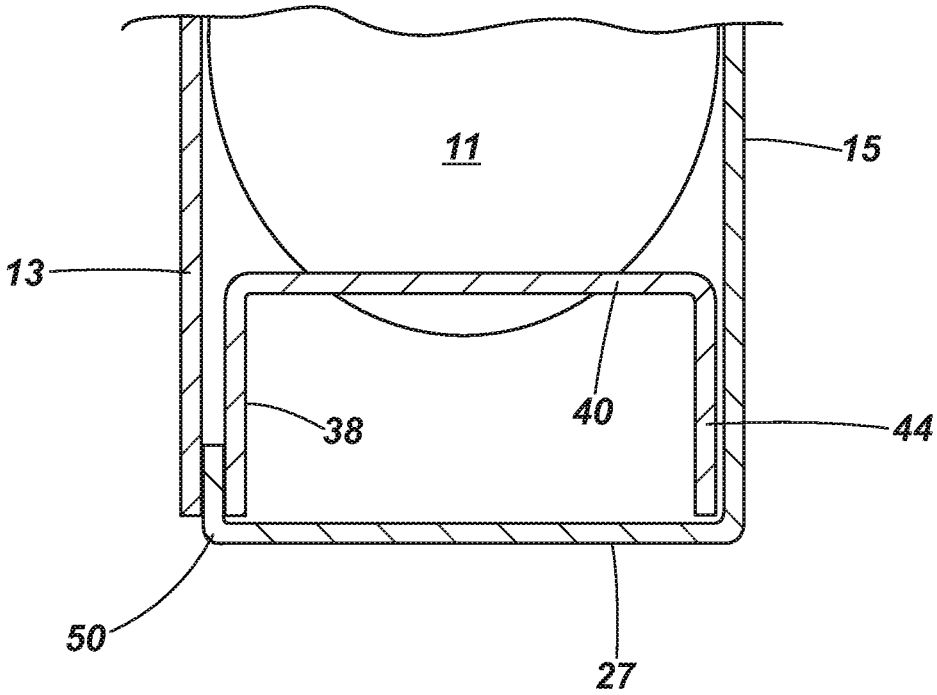
FIG. 7 is a view similar to that of FIG. 2 but showing a modified carton formed from the blank of FIG. 6.
Figure 6:
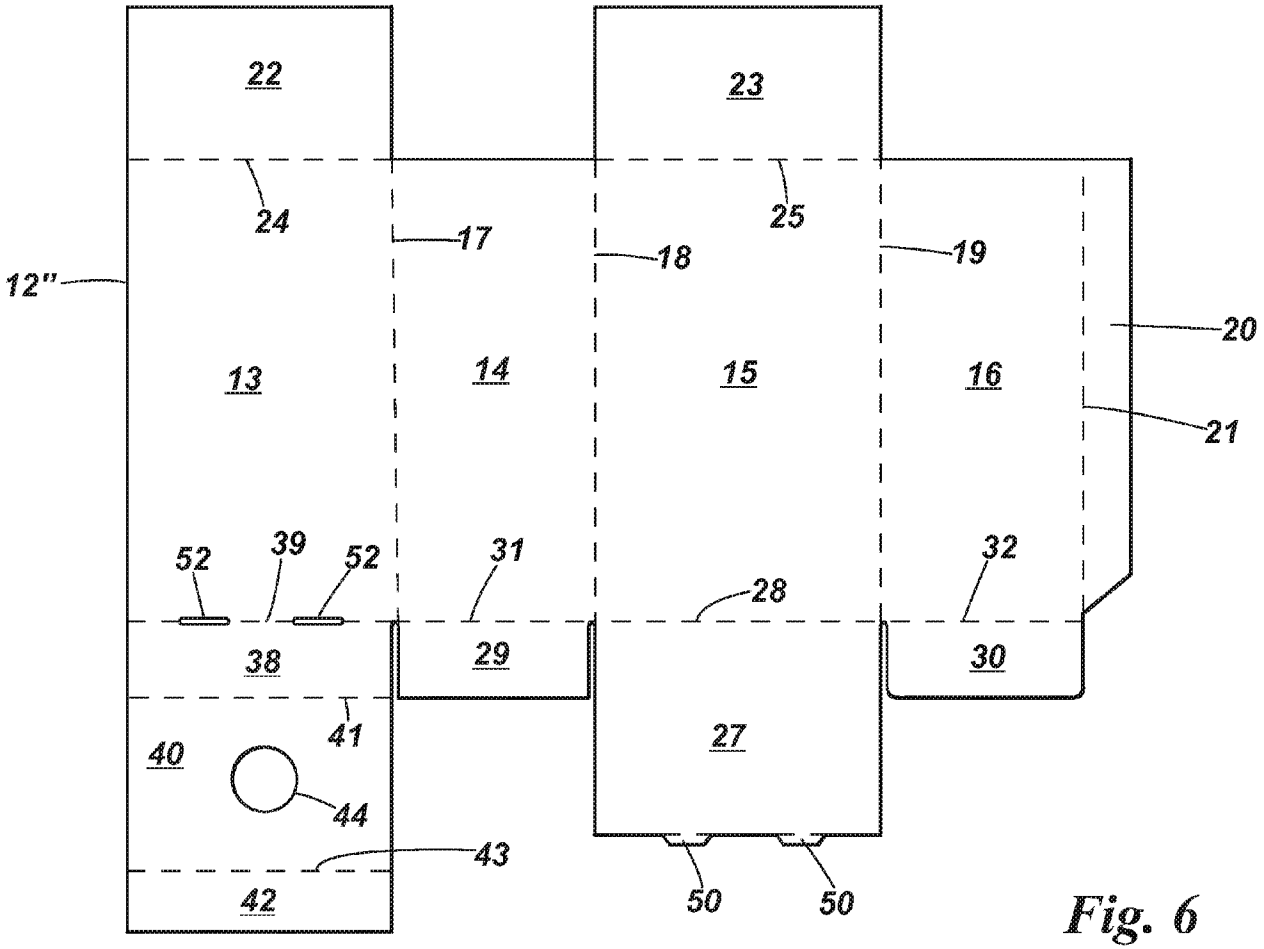
FIG. 6 is a plan view of a blank for forming a further modified version of the carton of FIG. 1.
Figure 8:
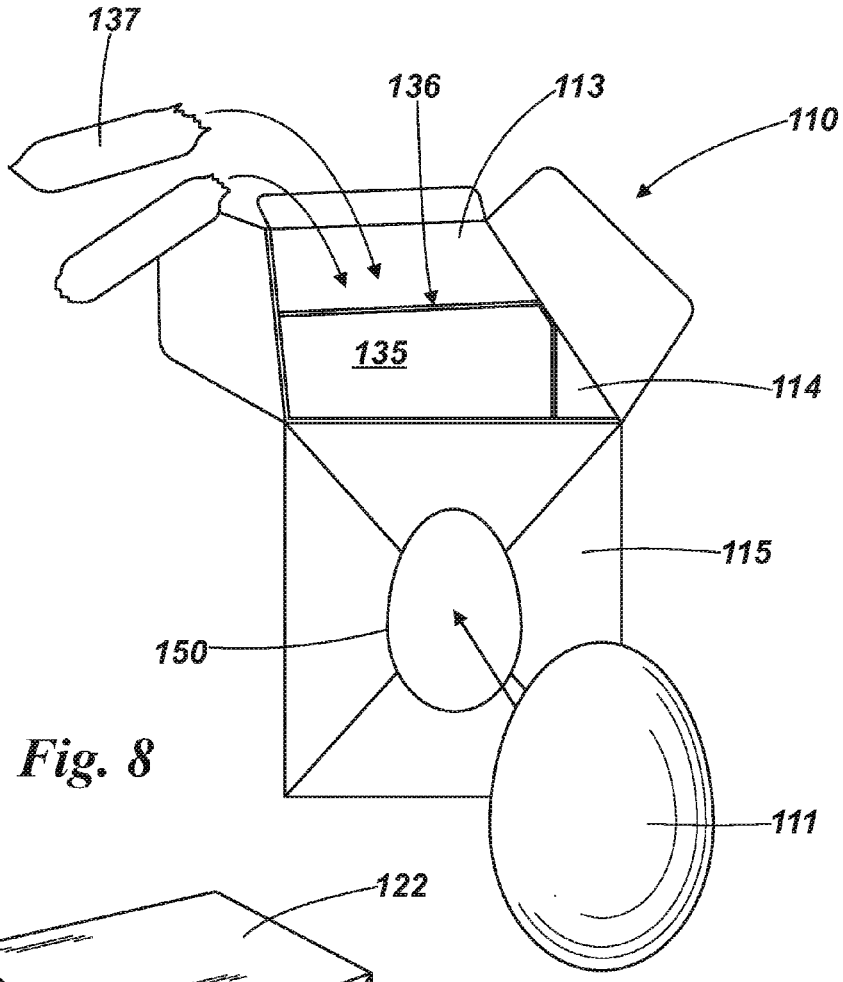
FIG. 8 is a perspective exploded view of a carton in accordance with a second embodiment of the invention, showing the carton prior to the egg and secondary confectionery being inserted.
Figure 9:
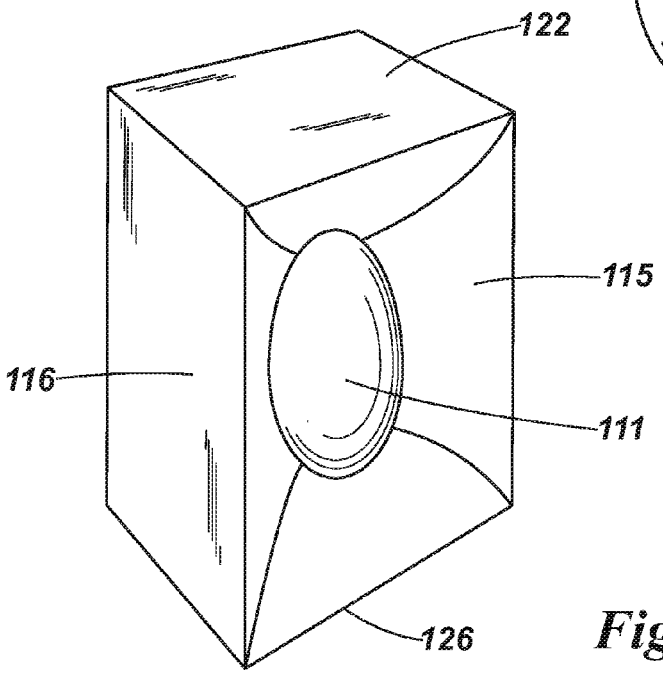
FIG. 9 is a view similar to that of FIG. 3 but shown the completed carton with the egg in position.

FIGS. 6 and 7 illustrate a modified arrangement for securing the lower end closure flap 27 in position. As shown in FIG. 6, instead of having an elongate tab 33 at the free end of the flap 27, the modified blank 12" has a pair of tabs 48 on the free end of the flap 27. The tabs 48 locate in a corresponding pair of slots 52 formed in the fold line 39 between the first side wall panel portion 13 and the first divider tab portion 38 in the completed carton, as illustrated in FIG. 7.

The method of securing the divider or an end closure flap in position using one or more tabs that engage in corresponding slots can be adopted in any of the embodiments disclosed herein.

FIGS. 8 to 11 illustrate a second embodiment of a carton 100 in accordance with the invention. The carton 110 is similar to the carton 10 and is formed from a blank having sidewall panels 113-116 which fold to form a rectilinear, hollow walled tubular structure for surrounding an egg 111. The carton 110 differs from the carton 10 in that it has a divider 135 which is aligned longitudinally of the structure rather than transversely. Thus when the carton 110 is in an upright orientation, the divider 135 extends generally vertically. The divider 135 is spaced inwardly from a first side wall panel 113. The opposite side wall panel 115 is adapted so that the egg 111 is inserted into an opening 150 formed in the panel 115 in a known manner.

The divider 135 may have an opening in which one side of the egg 111 is received to help support the egg. The space between the divider and the first side wall 113 forms a volume 136 for receiving a secondary confectionery item 137. The carton has upper and lower closures 122, 126 which are formed by means of various flaps and/or tabs in a known manner. The divider 135 extends the whole length of the hollow walled structure so that when the upper and lower closures are formed, the volume 136 is fully enclosed to securely hold the secondary confectionery item in place. This arrangement is particularly suitable for holding a number of otherwise loose secondary confectionery items.

The internal divider 135 is formed integrally with the carton in a manner similar to that described in relation to the first embodiment 10, except that in this case the first divider tab 138 is foldably connected along a free side edge of one of the side panels 113, 116.

Figure 10:
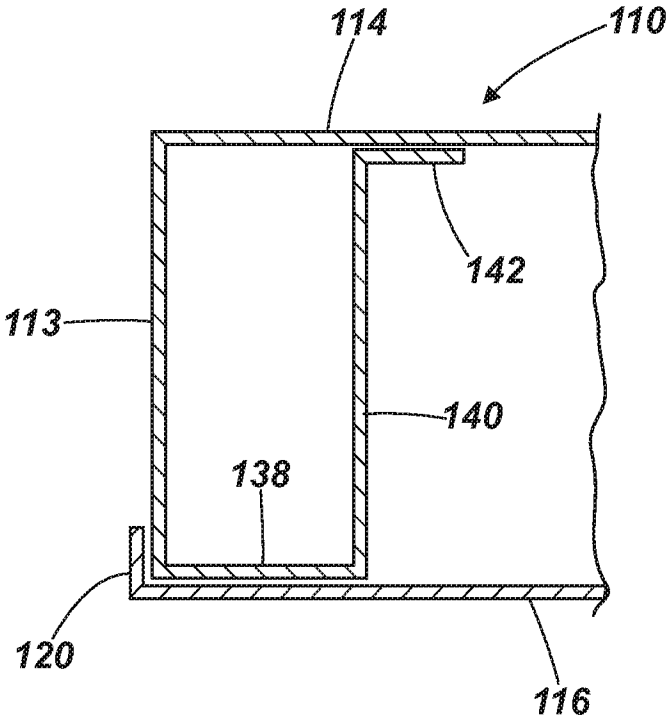
FIG. 10 is a cross sectional view through part of the carton of FIGS. 4 and 5 illustrating one arrangement for forming an internal divider.

FIG. 10 illustrates one arrangement for forming the divider 135 in which the first divider tab 138 is foldably connected to a side edge of the first side wall panel 113. The side wall panels 113-116 are folded to form a hollow walled structure and the side tab 120 is secured to the outside of the first side wall panel 113. The first divider tab 138 is folded so as to extend substantially parallel to the fourth side wall panel 116. The main divider panel 140 is folded so as to extend across the hollow walled structure towards the second side wall panel 114 parallel to the first side wall panel 113. The second divider tab 142 is folded so as to lie parallel to the second side wall panel 114. The first and second divider tabs 138, 142 may be secured to their respective side wall panels 114, 116 by means of an adhesive but this is not essential.

Figure 11:
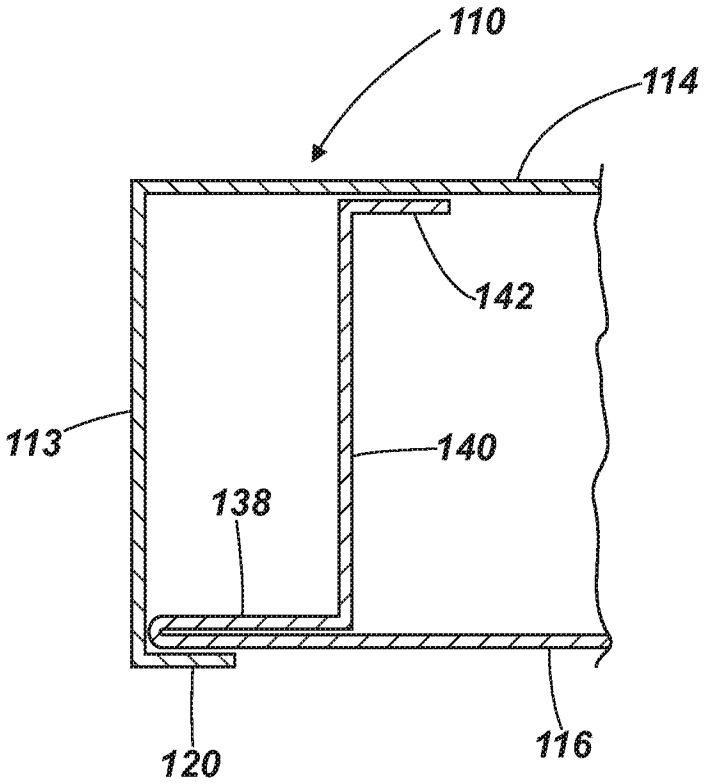
FIG. 11 is a view similar to that of FIG. 6 but showing an alternative arrangement for forming the divider.

FIG. 11 illustrates an alternative arrangement for forming the divider in which the first divider tab 138 is connected to a side edge of the fourth side wall panel 116. In this case, the first divider tab 138 is folded back over the fourth side wall panel 116 and the side tab 120 is provided on the free edge of the first side wall panel 113 and is secured to the fourth side wall panel 116.

The carton 110 can be modified so that the egg 111 is inserted though the upper or lower end rather the through a side wall as shown.

Figure 12:
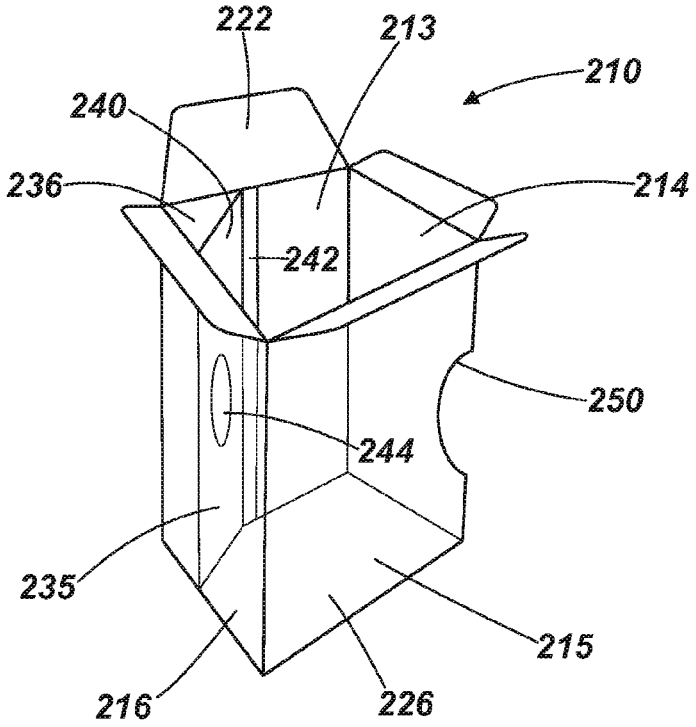
FIGS. 12 to 15 are schematic perspective views of cartons in accordance with further embodiments of the invention.

FIG. 12 illustrates a further embodiment of a carton 210 in which the internal divider 235 is aligned in a vertical or longitudinal direction. In this embodiment, the main panel 240 of the divider extends across a corner of the carton between two adjacent panels 213, 216. As with the previous embodiment, the divider can be connected with a side edge of either the first side wall panel 213 or the fourth side wall panel 216. The carton 210 has an opening 250 for the egg formed in the opposite corner of the carton where the second and third side wall panel portions 214, 215 meet and a corresponding opening 244 in the divider 235. Side regions of the egg locate in the openings to hold it in position. The volume 236 between the divider 235 and the corner of the carton can be used to hold one or more secondary confectionery items. The divider 235 extends the whole length of the hollow walled structure so that the volume 236 is closed at either end by the upper and lower end closures 222, 226 of the carton.

In FIG. 12, side wall panels 215 and 216 are shown as transparent to allow the internal details to be seen.

Figure 13:
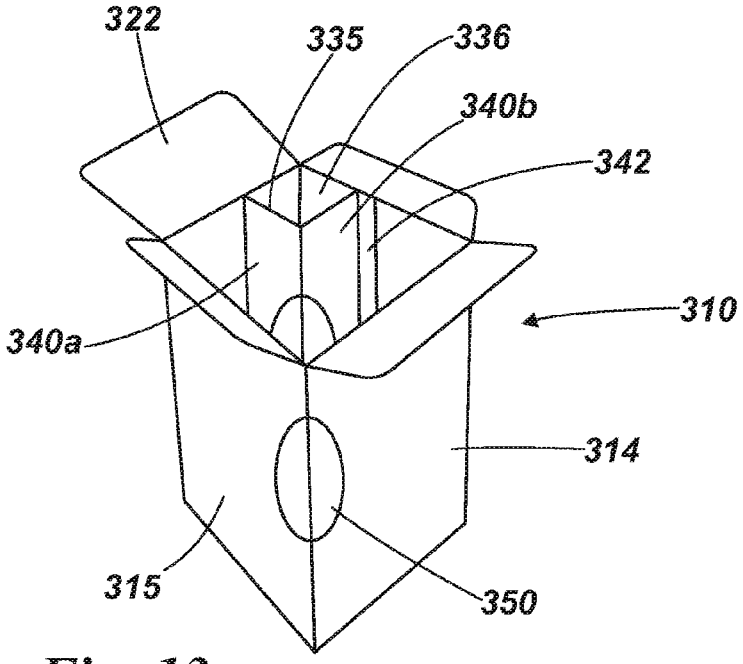

FIG. 13 illustrates a further embodiment of a carton 310 in accordance with the invention. This embodiment is very similar to the previous embodiment except that the main panel of the internal divider is formed in two panel parts 340*a*, 340*b* that are bent at 90 degrees to one another. This results in the divider defining volume 336 for receiving a secondary confectionery item between itself and the corner of the carton that has a substantially square or rectangular cross section.

Figure 14:
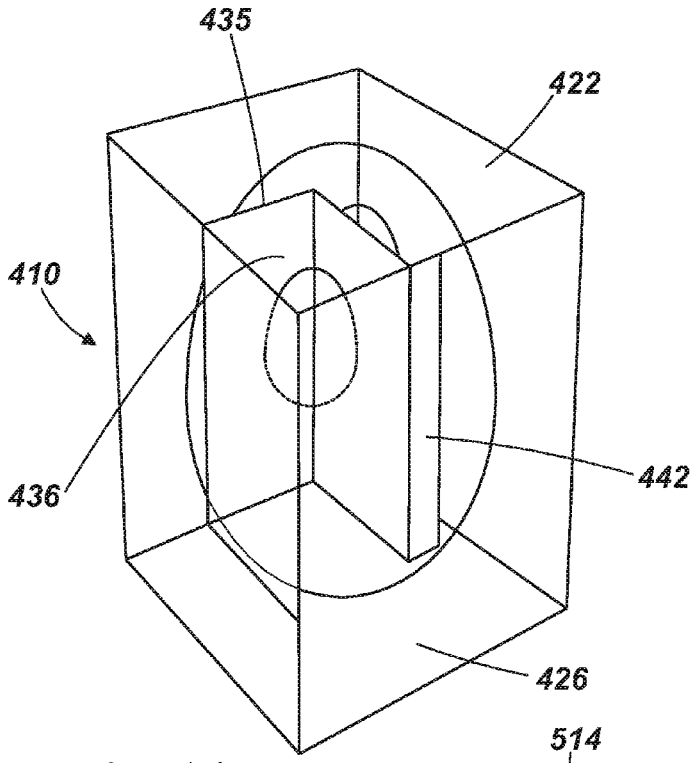

FIG. 14 illustrates a still further embodiment of a carton 410 in accordance with the invention. The carton 410 in this embodiment is essentially the same as the previous embodiment except that in this case the divider 435 only extends over part of the length of the hollow walled structure. As a result, the upper and lower ends of the volume 436 defined by the divider are not closed off by the upper and lower closures 422, 426 of the carton. This embodiment may be suitable for holding one or more elongate secondary confectionery items, such as chocolate bars, which can be inserted into the volume 436 without falling out. In this arrangement the divider forms a tube like structure with the side walls of the carton to hold one or more confectionery items.

Figure 15:
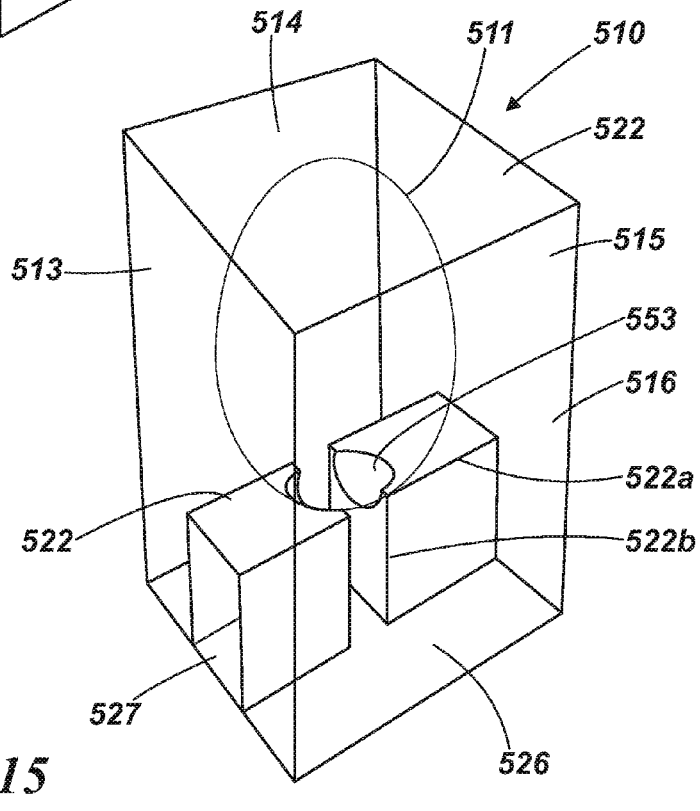

FIG. 15 illustrates yet another embodiment of a carton 510 in accordance with the invention. As with the previous embodiments, the carton comprises four side wall panels 513-516 which form a tubular hollow walled structure and has upper and lower end closures 522, 526. In this embodiment, the internal divider is formed in two parts by means of two kick-ins 552 provided at a lower edge on opposite sides of the hollow walled structure.

The term "kick-in" refers to a feature formed in a carton which is produced by means of two, usually parallel, cuts which extend across a fold line in the blank. When the blank is folded, the strip of material between the cuts is pushed inwardly so that the direction of the fold in the strip is reversed. This creates a generally "L" shaped projection in the carton which can be useful for a variety of purposes.

In the present embodiment, the kick-ins are formed by means of cuts in opposing side wall panels 513, 515 which extend into corresponding flaps connected to the lower edges of the panels 513, 515 and which form part of a closure 526 for the lower end of the carton. When the kick-ins 552 are pressed in, they each form an "L" shaped up-stand having two panel portions 552*a*, 552*b*. One panel portion 552*a* extends generally horizontally inwardly from the remainder of their respective side wall panel 513, 515 and one 552*b* extends vertically upwardly from their respective lower end closure flap. An opening 553 is provided in the blank at the fold line where the two panel portions 552*a*, 552*b* meet in each kick-in so that a concave recess is formed between the two kick-ins in which the base of the egg 511 can sit.

A further flap 527 is connected to the lower edge of one of the other side wall panels 214, 216. In the completed carton, the further flap extends across the lower end of the carton so as to close off the volumes defined inside the kick-ins from below. Further flaps may be provided which cover the opening in the side panels 213, 215 formed by the kick-ins so that the interior of one or both of the kick-ins can be used as a volume for retaining one or more secondary confectionery items.

Cartons in accordance with the invention provide a simple arrangement for securely packaging an Easter egg together with a secondary confectionery item that can be formed from a unitary blank. This reduces the amount of packaging required and simplifies methods of assembling and filling the carton. It will be appreciated that the embodiments disclosed herein are only examples and that many different arrangements can be produced within the scope of the invention. For example, whilst all the embodiments disclosed comprise cartons having four side wall panels to form a rectilinear, tubular hollow walled structure, this is not essential and the carton may have more than four side wall panels or fewer. Indeed, the invention can be equally applied to a carton having a cylindrical hollow walled structure. Whilst the invention is particular suitable for packaging hollow confectionery products such as Easter eggs and hollow chocolate animals together with secondary confectionery items it can be used for packaging any main product in association with a secondary item.

The invention claimed is:

1. A carton for packaging a main product and at least one secondary item, the carton comprising a unitary blank of foldable material folded to produce a hollow walled structure in the form of a tube having a polygonal cross section and having four or more generally planar side wall panels and having one end, said hollow walled structure for encircling the main product, the blank also being folded to produce at least one internal divider which forms a support to assist in holding the main product in position in the structure and to define within the hollow walled structure an internal volume completely contained within the hollow walled structure for retaining the at least one secondary item, in which the carton is configured to hold a main product in the form of a hollow confectionary product;

whereby the at least one internal divider extends transversely across the structure at a position spaced inwardly from said one end, the blank further comprising one or more flaps which form an end closure for the hollow walled structure at or close to said one end so that the internal volume for retaining the at least one secondary item is defined within the hollow walled structure between the at least one internal divider and the end closure;

wherein the at least one internal divider comprises a first divider tab foldably connected with side wall panels of the hollow walled structure, a main divider panel foldably connected with the first divider tab and at least one second divider tab connected with the main divider panel;

and wherein the main divider panel comprises two or more panel portions separated by fold lines, each panel portion extending at an angle to an adjacent panel portion and having an opening to receive part of the main product.

2. A carton as claimed in claim 1, in which said one end is a lower end when the carton is positioned upright.

3. A carton as claimed in claim 1, in which a free end of the at least one second divider tab is supported by the end closure.

4. A carton as claimed in claim 1, in which at least one of the first and second divider tabs is bonded to the inner surface of its respective side wall panel.

5. A carton as claimed in 1, in which the at least one second divider tab is received in a corresponding slot in side a said side wall panel of the carton.

6. A carton as claimed in claim 1, in which the carton is configured to hold a main product in the form of an Easter egg or hollow chocolate animal.

7. A carton as claimed in claim 1, in which the at least one secondary item is a confectionery item.

8. The carton as claimed in claim 1 formed from a unitary blank of foldable material.

9. A package assembly comprising a carton as claimed in claim 1, a main product located within the hollow walled structure and supported by the at least one internal divider, and at least one secondary item located within the internal volume.

* * * * *